US006250035B1

(12) United States Patent
Bristow et al.

(10) Patent No.: US 6,250,035 B1
(45) **Date of Patent: *Jun. 26, 2001**

(54) MODULAR SYSTEM FOR THE CREATION OR CLADDING OF WALL, CEILING AND/OR FLOOR SURFACES AND THE CONSTRUCTION OF FUNCTIONAL SURFACES AND FUNCTIONAL WALLS

(75) Inventors: Paul Anthony Bristow, Bergen op Zoom (NL); Klaus W. Göcke, Detmold (DE); Frank-Martin Bub, Siegen (DE); Jürgen Heitmann, Enger (DE)

(73) Assignee: LOGY Design und Ehlebrecht Gesellschaft zur Verwertung gewerblicher Schutzrechte mbH, Enger (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/344,310

(22) Filed: Jun. 24, 1999

Related U.S. Application Data

(62) Division of application No. 08/805,630, filed on Feb. 26, 1997, now Pat. No. 5,941,038.

(30) Foreign Application Priority Data

Feb. 27, 1996 (DE) ..... 196 07 344
Nov. 5, 1996 (DE) ..... 196 45 575

(51) Int. Cl.[7] ..... E04B 2/18

(52) U.S. Cl. ..... 52/506.1; 52/582.1; 52/586.2; 52/590.3; 52/592.2; 52/592.3; 52/591.1; 52/592.5

(58) Field of Search ..... 52/506.06, 506.08, 52/506.09, 506.1, 582.1, 586.1, 586.2, 585.2, 585.1, 585.9, 590.1, 590.3, 592.3, 592.2, 592.4, 591.1, 592.5

(56) References Cited

U.S. PATENT DOCUMENTS

| | | | |
|---|---|---|---|
| 1,716,626 | | 6/1929 | Devol . |
| 5,555,690 | | 9/1996 | Consentino . |
| 5,657,602 | | 8/1997 | Hellander . |
| 6,026,625 | * | 2/2000 | Austin ..... 52/591.5 |

FOREIGN PATENT DOCUMENTS

| | | |
|---|---|---|
| 29601954 U | 7/1995 | (DE) . |
| 0044371A1 | 1/1982 | (EP) . |
| 0151420A2 | 8/1985 | (EP) . |
| 0169061A2 | 1/1986 | (EP) . |
| 0544604B1 | 6/1993 | (EP) . |
| 0561778B1 | 9/1993 | (EP) . |
| 2231829 | 12/1974 | (FR) . |

* cited by examiner

*Primary Examiner*—Carl D. Friedman
*Assistant Examiner*—Yvonne M. Horton
(74) *Attorney, Agent, or Firm*—Townsend and Townsend and Crew LLP

(57) ABSTRACT

A modular system that includes a plurality of modular elements that can be coupled together in a hidden manner with respect to the visible side. The modules are formed as areal, frame-like or three-dimensional shaped parts and are freely combinable with one another. At least substantially flat modular elements or flat modular element regions have a plurality of mutually spaced apart coupling and fixing members that project beyond a boundary edge of the module. Insert grooves are provided at a rear side of the module for the shape-locked and force-transmitting reception of coupling and fixing members of adjacent modules.

10 Claims, 18 Drawing Sheets

MODULAR SYSTEM FOR THE CREATION OR CLADDING OF WALL, CEILING AND/OR FLOOR SURFACES AND THE CONSTRUCTION OF FUNCTIONAL SURFACES AND FUNCTIONAL WALLS

This Application is a Division of Ser. No. 08/805,630 filed Feb. 26, 1997, U.S. Pat. No. 5,941,038.

FIELD OF THE INVENTION

The invention relates to a modular system for the cladding of surfaces and for the construction of functional surfaces and functional walls, the modular system including a plurality of module elements which can be coupled together in a hidden manner relative to the visible side.

DESCRIPTION OF PRIOR ART

A constructional element for the cladding of surfaces with surface elements, in particular wall and/or floor tiles, is known from German utility model 29501945.9, with the special feature of this constructional element lying in the fact that a plate-like base carrier element is provided which has at least one surface element and is releasably connectable both to the surface to be clad and also to complementary basic carrier elements.

The surface elements can either be fixedly or releasably mounted on the base carrier element and the base carrier elements themselves are provided with tongues and/or grooves which enable the coupling together of adjacent base carrier elements.

Wall claddings, in particular in wet rooms, can be provided by means of such constructional elements, the surface elements of which can, for example, consist of tiles, wood, marble, metal or ceramic elements and which, in contrast to conventional tiling, can be erected with a small expenditure of time and which are particularly suitable for renovation purposes and can also, if required, be simply removed or modified.

OBJECT OF THE INVENTION

The principal object of the present invention is to provide a modular system of the initially named kind which, while retaining the advantages of the known cladding system, on the one hand results in a simplification of both the constructional elements and also their processing and installation and, on the other hand, leads to an increase of the design possibilities from a technical and aesthetic point of view. Furthermore, the sealed nature of the walls that are formed against the penetration of water is to be ensured in a simple and effective manner and the sealed nature and optical appearance of the joints is also to be ensured even with expansion of the tiles.

BRIEF DESCRIPTION OF THE INVENTION

This object is satisfied in accordance with the invention essentially by a modular system comprising a plurality of modular elements which can be coupled together in a hidden manner with respect to the visible side, the modules being formed as areal, frame-like or three-dimensional-shaped parts and being freely combinable with one another, wherein at least the substantially flat modular elements or flat modular element regions have a plurality of mutually spaced apart coupling and fixing members which project beyond a boundary edge of the module (1) and also insert grooves provided at the rear side of the module for the shape-locked and force-transmitting reception of coupling and fixing members of adjacent modules.

Provision is preferably made for the coupling and fixing members to be formed on adapter elements which are to be used horizontally and for them to be arranged on both sides of a centrally extending sealing strip integrated into this adapter element. In addition, provision is usefully made for the combination of such adapter strips to be used horizontally, with connection sections which are to be used vertically and which have an analogous construction with respect to the sealing strip design and its retention.

Through the design and arrangement of the coupling and fixing members and also of the insert grooves, there results, on the one hand, a simple mounting technique, which is, on the other hand, particularly variable, since the modular elements can be cut to length steplessly both vertically and also horizontally and also with inclined cuts and can be installed without further adaptation using the same mounting technique.

The module elements can be mounted both directly via hidden screw strips to the particular surface to be clad, but can, however, also be installed on an installation register and can, if required, also be directly adhesively bonded to the surface to be clad, for example to the floor. In the latter case, the insert grooves provided at the rear side ensure a particularly reliable bond because of the interlocking effects which result.

The installation on an installation register result in particular advantages, since in this case one can not only provide functional spaces between the wall and the cladding for the accommodation of supply lines and the like but rather the use of three-dimensional module elements is also made possible. In this way functional walls can be provided with which the separate installation of shelves, holders, cupboards and the like, which is customary in wet rooms, can be avoided because a direct integration into the wall construction can take place.

The coupling and fixing members and the insert grooves which extend substantially over the entire height of the respective module element are preferably designed such that in the coupled state undercut or interlocking connections can be produced in the manner of a dove-tail connection. In this way a very precise mutual coupling of the module elements is ensured and it is certain that the holding forces which act perpendicular to the module plane act uniformly and uniformly distributed so that flat surfaces can be achieved from a plurality of module elements without problem.

The visible side of the module is preferably formed as a decorative surface part and the rear side of the module as a functional surface part. The decorative surface part and the functional surface part are thereby mutually displaced relative to one another so that at the front side of the functional surface part and at the rear side of the decorative part two overlapping margins extending perpendicular to each other are formed in each case, with these overlapping surfaces forming carrier surfaces for sealing material, in particular for a shaped seal part which is lightly pre-stressed when the module elements are installed and ensures the required sealing, in particular sealing against water spray together with the overlap in the horizontal and vertical region. Joint gaps can, if required, also be optically filled by manual silicon jointing or with customary tile grouting materials.

The module elements preferably consist of at least two-layer sandwich component since in this manner an economical material can be used for the functional surface part, whereas a high quality material can be used for the visible surface part and can be selected in accordance with the respective requirements. The modules consist in particular of injection molded parts which can be manufactured with very high accuracy and indeed not only in the shape of planar elements but rather in the same manner in the shape of three-dimensional elements. For the manufacture of these modules and in particular of the decorative surface parts, high quality, highly filled polymers are preferably used which satisfy all requirements both from the technical manufacturing view point and also from the view points of technical use and aesthetic appearance. It should, however, be mentioned that the decorative surface parts, or at least in a covering material layer on the decorative surface parts, can consist of all materials which are customary for cladding elements, in particular also of ceramic material.

In accordance with a preferred design of the invention the module elements can consist of a frame-like functional part and insert units which can be connected thereto. These insert units can, for example, be switches, installation sockets, armatures, light outlet surfaces, actuating members, holding devices, access covers for service and repair purposes, ventilating and extraction units or also functional units such as dispenser units, vertically adjustable shower outlets and the like.

It should, furthermore, be mentioned that the module units must in no way only be of flat design, but rather these module units can also be three-dimensionally shaped and in particular three-dimensionally shaped parts in the form of curved connection parts, termination parts and also inner and outer corner parts can be coupled to the flat module elements. In this manner shaped designs can be achieved in the claddings and in particular for the functional walls which are to be produced, which can be not be achieved, for example, by means of ceramic tiles. In particular very gentle or soft transitions can be created between surfaces which extend at an angle to one another and a utilization of the third plane in form of projecting or set-back surface regions is possible.

An advantageous field of use of the modular system of the invention lies in the field of renovation of wet rooms and bathrooms, with it being particularly favorable that precise pre-planning is possible and a new interior room can be provided within a short space of time and practically within the context of a single trade, without removing existing tiled claddings, and with sanitary and electrical connections being prepared in interface-like manner.

BRIEF LISTING OF THE FIGURES

FIG. 1 is a perspective oblique view of the front side of a module element with a partially illustrated carrier rail, FIG. 2 is a rear view of the module element of FIG. 1, FIG. 3 is a plan view of two adjoining module elements, FIG. 4 is a sectional view corresponding to the line A—A in FIG. 3, FIG. 5 is a detailed representation of a screw fixing for a module, FIG. 6 is a detailed representation of a clamped fixing for a module, FIG. 7 is a perspective illustration of a partly finished installation register, FIG. 8 is a detailed representation to explain the function of the installation register, FIG. 9 is an exploded illustration of a multi-part module element, FIG. 10 is a perspective illustration of a right-angled connection element, FIG. 11 is a sectional illustration of the connection element of FIG. 10 with coupled together module elements, FIG. 12 is a perspective illustration of a section of an angled connection element capable of being formed into an angle, FIG. 13 is a perspective illustration of a corner section part for the provision of horizontal, plugged and latched connection between modules, FIG. 14 is schematic perspective illustrations of a shelf area module and of a corner module, FIG. 15 is a schematic perspective illustration of cladding parts for a tub, FIG. 16 is a perspective illustration of a holder for a shelf and support surface realized by means of module elements, FIG. 17 is a perspective illustration of examples of three-dimensional module elements, FIG. 18 is a schematic perspective illustration of a rear view of a module element with an associated adapter element, connection section and corner connector, each separated from one another, FIG. 19 is a front view corresponding to FIG. 18, FIG. 20 is a perspective illustration analogous to FIG. 18 of the rear view of the module element, with the module element, adapter element, connection section and corner connector being coupled together, FIG. 21 is a perspective detailed illustration of an adapter element in a front view, FIG. 22 is a rear view of the adapter element corresponding to FIG. 21, FIG. 23 is a schematic cross-sectional illustration of the adapter element, FIG. 24 is a perspective front view of the connection section, FIG. 25 is a schematic cross-sectional illustration of the connection section of FIG. 24, and FIG. 26 is a perspective illustration of a corner connector.

DESCRIPTION OF PREFERRED EMBODIMENTS

FIG. 1 shows a flat or planar module element 1 having a visible side 2, which can in principle consist of any desired material; but which, however, preferably consists of a plastic material which can be injection molded or continuously cast or extruded, in particular of a highly filled polymer.

The module element 1 accordingly includes a decorative surface part 12 and a functional surface part 13 lying behind it. Both parts can consist of the same material, but are, however, preferably made of different materials in order to use a high quality material for the decorative surface part 12, or at least for a coating of the decorative surface part, and to use a more economical material, which, however, fully satisfies the mechanical requirements, for the functional surface part.

The module element 1 is provided at its upper side with a plurality of mutually spaced coupling and fixing members 4 which are preferably directly molded onto the functional surface part 13 and project beyond the upper boundary edge 5 of the functional surface part 13. These coupling and fixing members 4 have cut-outs 7 which are so designed that the module element 1 can in particular be screwed or clamped to carrier rails 14. The cut-outs 7 are thereby provided with suitable inclined surfaces so that the fastening members lie in a recessed manner and do not impair the coupling function.

In the embodiment of FIG. 1 a clamping clip 9 is shown in connection with the module element 1 and the carrier rail 14. For the purpose of fixing the module element 1 the clamping clip engages over one limb of the U-shaped carrier rail 14 and the respective coupling and fixing member 4 from above and thus clamps the module element 1 to the carrier rail 14. The limb of the clamping clip 9 associated with the coupling and fixing member 4 is provided with inclined surfaces complementary to the inclined surfaces of the cut-out 7 in the coupling and fixing member 4, so that this clamping clip lies flush with the outer surface of the coupling and fixing member.

In the case of using such clamping clips 9, some fastening screws 8 or other blocking elements distributed over the total surface to be formed should be set in place additionally to avoid shifts of the module elements.

The decorative surface part 12 and the functional surface part 13 are arranged displaced relative to one another so that overlapping margins 15, 16 arise at the front side, which serve to accommodate a shaped sealing element.

A narrow blocking or coupling groove 21 is formed in the vertically extending overlapping margin 16 and serves, in the same manner as the inclined surface 24 provided in the region of the coupling and fixing members 4, to ensure the sealed nature of the joint between two coupled module elements.

FIG. 2 shows the rear side of the module element of FIG. 1. In addition, the rear overlapping margins 17, 18 can be seen which arise by the mutual displacement of the decorative surface part 12 and of the functional surface part 13.

In the rear side of the module element 1, i.e. especially in the functional surface part 13, there are formed a plurality of grooves 6, henceforth referred to as insert grooves, which correspond to the number of coupling and fixing members 4 and extend over almost the full height of the module element 1.

The cross-sectional shape of these insert grooves 6 corresponds to the cross-sectional shape of the coupling and fixing members so that these coupling and fixing members 4 can engage in form-locked and force-transmitting manner into the insert grooves 6 of a neighboring module element 1. The connections between the coupling and fixing members 4 and the insert grooves 6 are preferably formed in the manner of dovetail connections.

The illustrations of FIGS. 1 and 2 show that the module elements 1 can be cut to length in stepless manner vertically and also horizontally, for example by means of a saw. The module elements which have been correspondingly reduced in size can still be installed with the same installation technique without further adaptations as result of the still remaining coupling and fixing members 4 and the remaining regions of the insert grooves 6. This brings about a high reliability and flexibility of the overall system starting from a standard module element.

Figure 3:
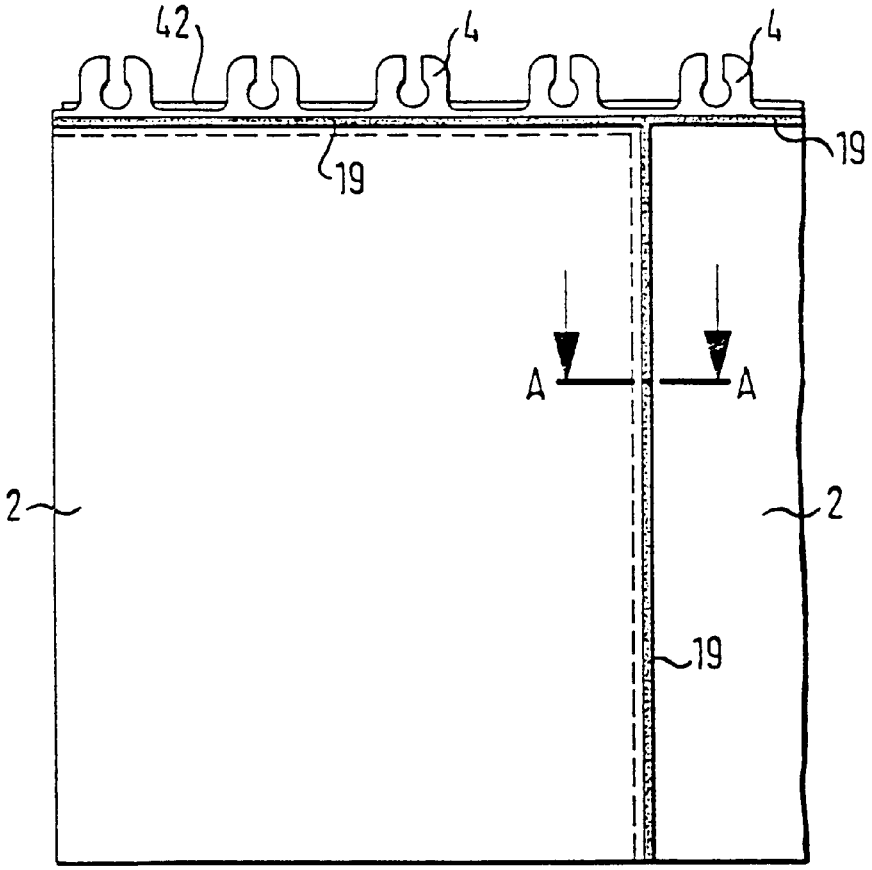
FIG. 3 shows the visible sides of two module elements arranged alongside one another and coupled together, with shaped sealing parts 19 being provided for the purpose of the joint seal.
Figure 4:
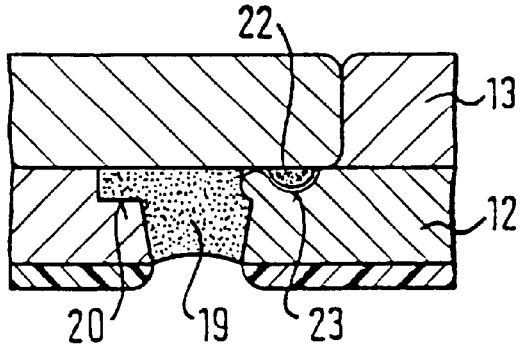
FIG. 4 shows a sectional illustration on the line A—A of FIG. 3 from which the nature of the lateral coupling and the mutual sealing of the two adjacently disposed module elements can be seen.

The shaped sealing element 19, which in accordance with the representation of FIG. 3 has two limbs extending mutually at right angles, is held in a gap 20 formed between the functional surface part 13 and decorative surface part 12 but can, however, also be provided in one of these two parts at a different position in order to ensure retention at the individual elements. In the illustrated sectional view it can also be seen that the decorative surface part 12 is provided with a special, in particular high quality visible surface layer.

The shaped sealing part 19 is matched with respect to its cross-sectional shape to the lateral boundary surfaces of the adjoining modules and is preferably under a light pre-stress in the installed state. The joint between the two module elements is thereby filled out and sealed off.

The sealing against water spray which is required in certain applications is taken care of on the one hand by the overlaps which result during the installation and on the other hand by the shaped sealing parts 19. As an addition, a sealing material strip 22 extending on an overlapping surface over the length of this surface can be provided, for example in the form of a molded-on, soft material, with the respectively associated counter-element having a complementary groove 23.

Figure 5:
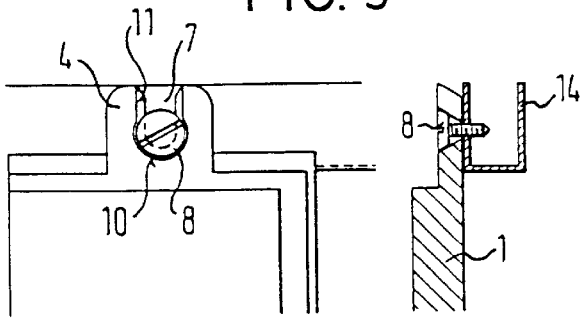

FIG. 5 shows, in the form of a partial illustration, the utilization of the recess 7 in the coupling and fixing member 4 to accommodate a counter-sunk mounting screw which can be connected to one limb of the carrier rail 14 and thereby fixes the module element 1 in all directions. In this arrangement the inclined surface sliding mount 11 for clamping clips can also be seen.

Figure 6:
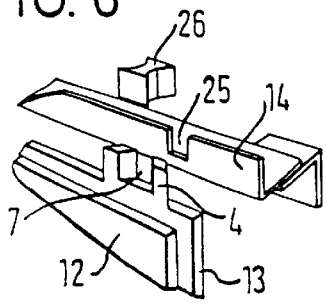

FIG. 6 shows a further example of a way of clamping the coupling and fixing member 4 to the associated carrier rail 14. In this case the carrier rail 14 is provided with cut-outs 25 and clamping wedges 26 are provided as clamping elements. With mutually aligned cut-outs 25, 7 in the carrier rail 14 and in the coupling and fixing member 4, the clamping wedges can be inserted from above into these cut-outs and lead, as a result of the inclined surfaces that are provided, to a mutual clamping of the carrier rail 14 and of the module elements 1, with the module elements 1 simultaneously being fixed in shape-locked manner in the horizontal direction. The coupling elements in the form of clamping wedge elements 26 and clamping clips 9 can indeed be manufactured from a plastic material free of deformation but are, however, preferably made of metal.

Figure 7:
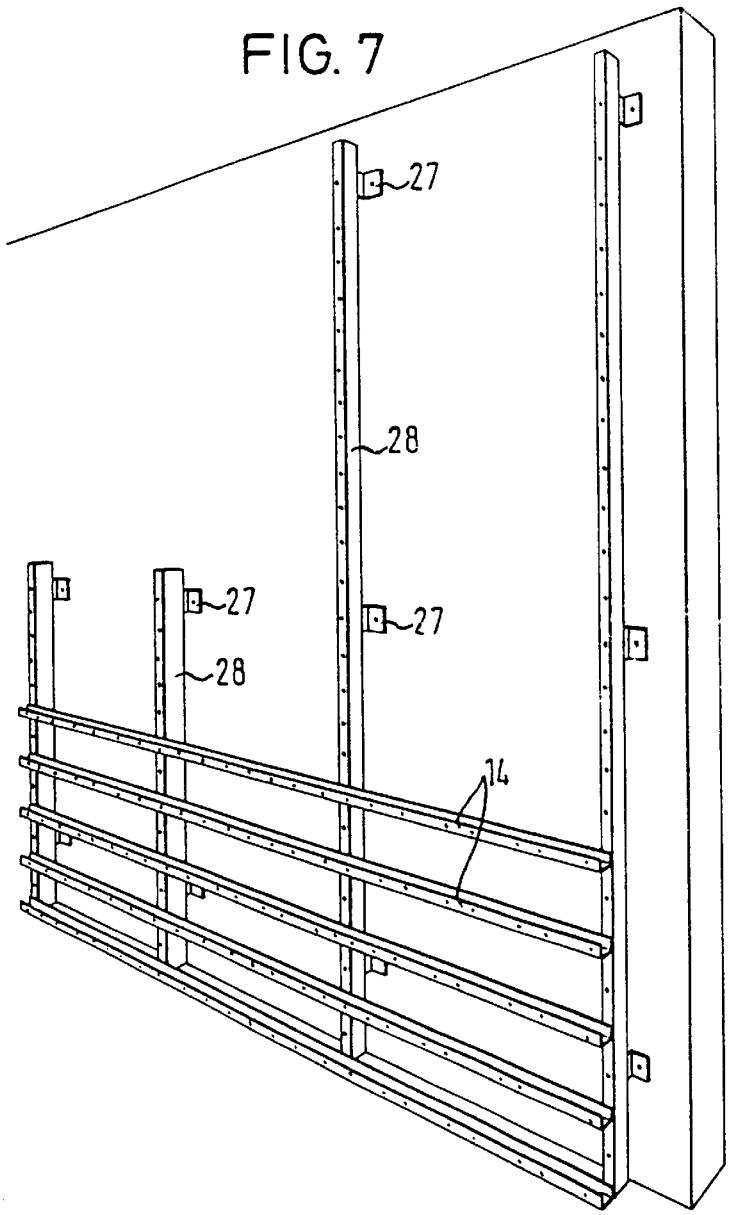

FIG. 7 shows an example of an installation register for the installation of the module system of the invention in front of a wall. This installation register consists of mounting parts 27 which are to be screwed to the respective wall, of vertical carrier strips 28 which can be connected to the latter and of horizontally extending carrier rails 14, which can be fixed to the vertical carrier strips 28. The mutual spacings between the carrier rails 14 are selected in accordance with the grid dimensions of the module elements, and the arrangement can also take place in such a way that a displacement of the module elements is possible, for example by half the height, so that the traditional pattern known from tiling techniques can also be realized.

Figure 8:
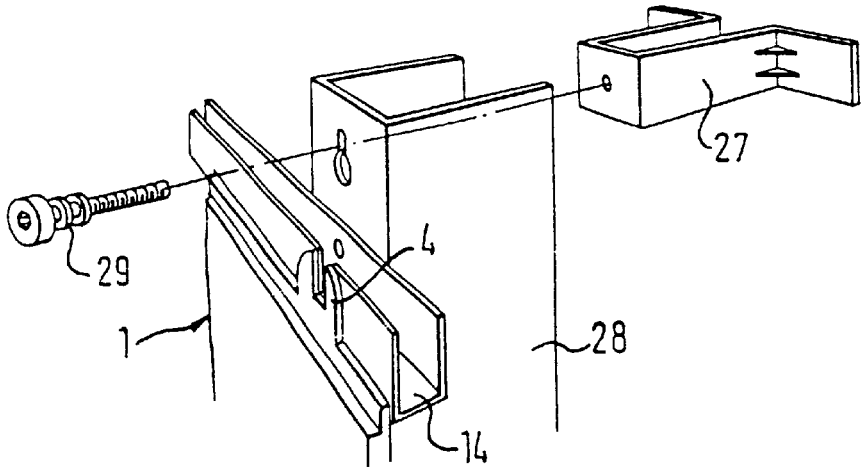

FIG. 8 shows a sectional detailed illustration of the installation register of FIG. 7 and allows the adjustment possibilities that are given to be seen.

The vertical carrier strips 28, which are U-shaped in cross-section, can be displaced relative to the wall mounting parts 27 which engage in shape-locked manner in order to obtain a precisely vertical and flat installation surface. For this purpose adjustment and mounting screws 29 are used, having a front thread part, which serves for screwed engagement with the wall mounting part 27, and a rear support ring part, which permits distance regulation via the coupling with the keyhole-like cut-out in the vertical carrier strip. However, all types of installation register can also be used which have the requisite alignment possibilities and permit the attachment of the module elements to the carrier rails 14 to take place in the required grid.

It should also be mentioned that, with correspondingly straight and flat walls, the carrier rails 14 can also be directly attached at the wall side, and that, as a rule, a coupling connection rail with coupling elements suitable to engage into the insert grooves is used at the floor side.

Figure 9:
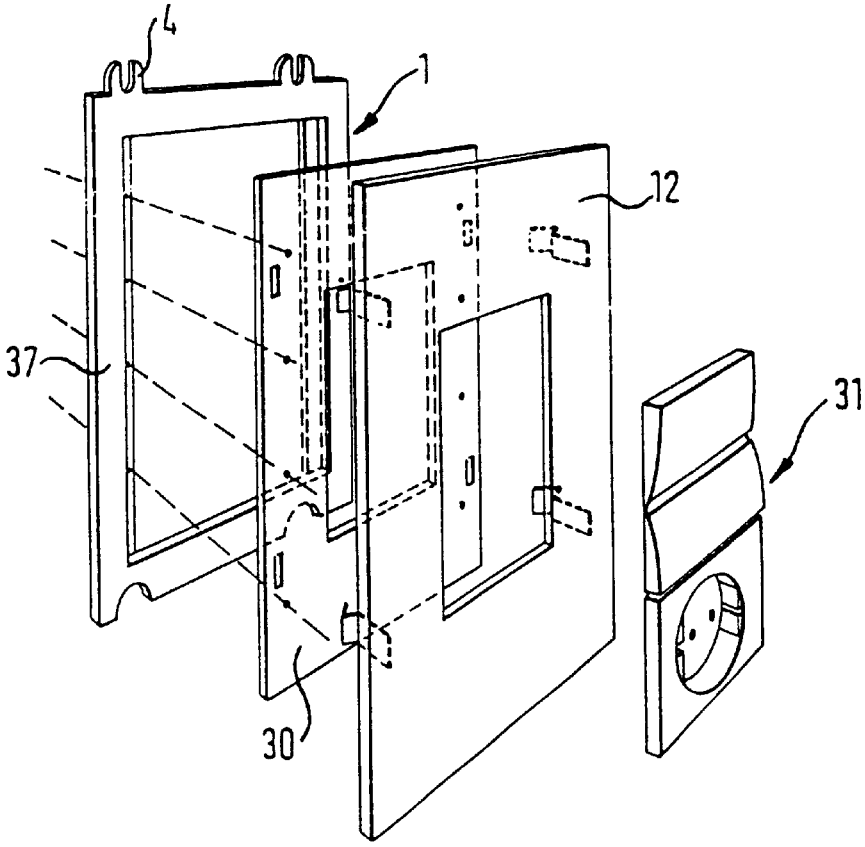

FIG. 9 shows a multi-part module element 1 which consists of a frame-like functional part 37 with coupling and fixing members 4 and which is also provided with insert grooves at the rear side. The installation of this frame-like functional part 37 can thus take place in the same manner as the installation of the other module elements.

The opening surrounded by the frame-like functional part 27, the size of which can be preset in each case, can be used for the mounting of the most diverse units. In the illustrated embodiment an intermediate plate 30 connectable to the frame-like functional part 37 is provided and can in turn be coupled via snap-latch connections to a decorative surface part 12, which has a recess for receiving a switch and connection socket unit 31. In the installed state it is thus only the decorative surface part 12 with the integrated electrical unit 31 which can be seen.

This example makes it clear that—as already explained—the module system of the invention can be combined with a multitude of very different units and indeed in the context of an extremely simple installation technique.

Figure 10:
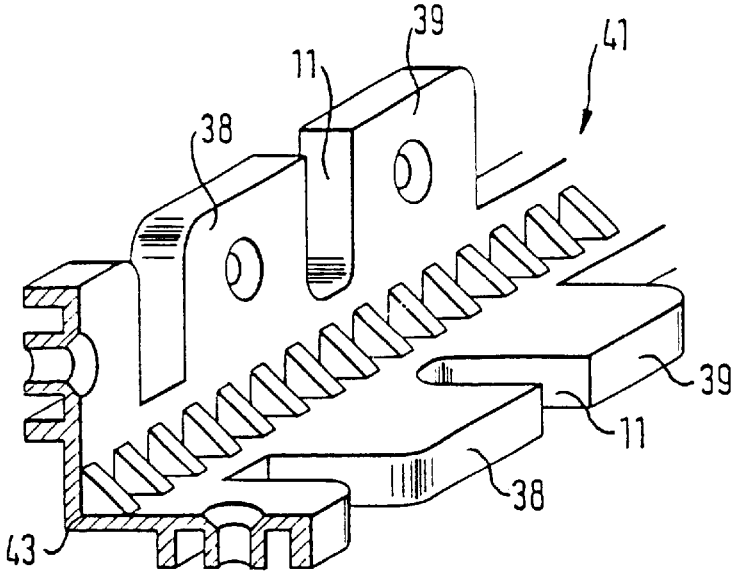
Figure 11:
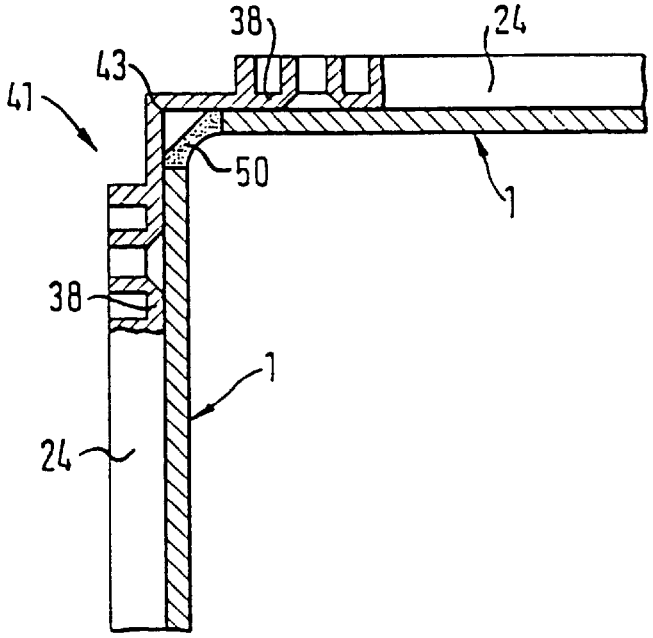

FIG. 10 shows a right-angled connection element 41 which in each case has a row of coupling and fixing members 38 and 39 on both sides of an angled edge 43. Module elements can be arranged precisely at right angles and coupled together by means of such a connection element 41 as is shown in FIG. 11. An expansion joint 50 thereby results in the corner region, which can optionally be filled out with resilient material.

The lugs 38, 39 engage in the already described manner into insert grooves which are formed by profiled webs which have yet to be explained in more detail.

Figure 12:
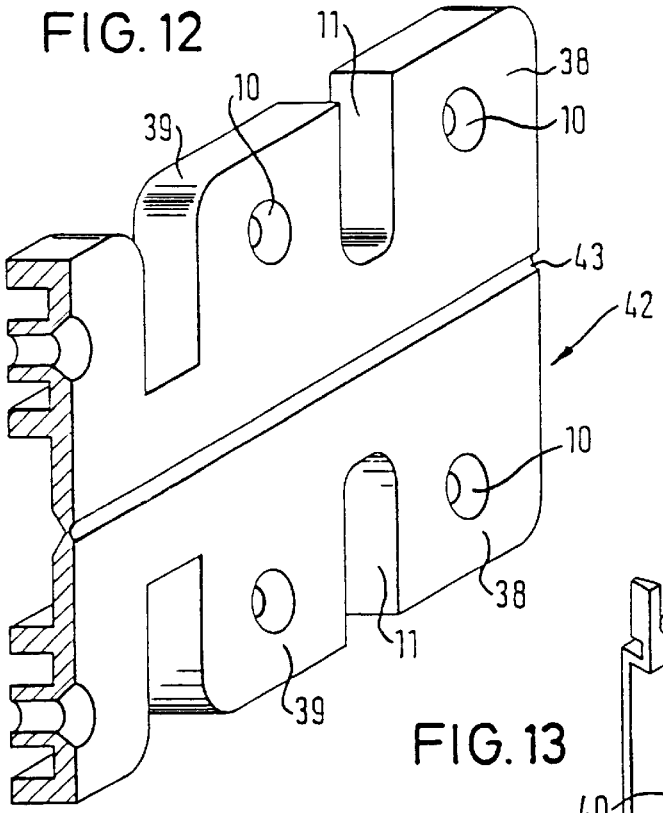

FIG. 12 shows an connection element 42 capable of being formed into an angle and having an the angled edge 43 which is formed in the manner of a film hinge. Each coupling and fixing member is in turn formed in this arrangement by a double-lug arrangement 38, 39, with a sliding mount 11 lying therebetween. An angled connection element of this kind makes it possible to achieve practically any desired transition connections between module elements which leads in the installation technique to high flexibility and corresponding advantages.

Figure 13:
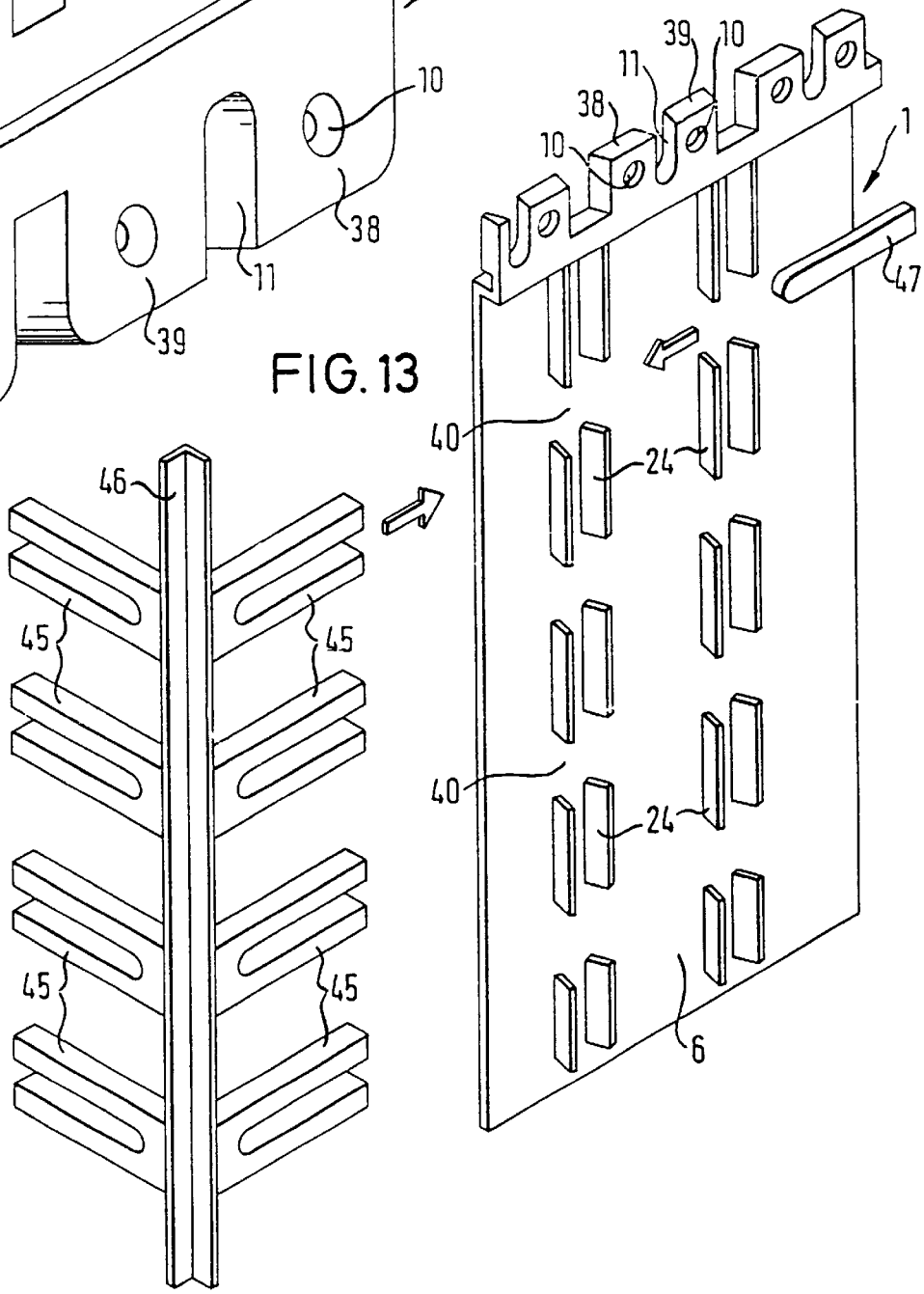

FIG. 13 shows the rear side of a module element 1 in connection with a sectional corner angle part 46, with molded on coupling lugs 45.

In this connection the design of the insert grooves 6 at the rear side of the respective module 1 is of particular importance. These insert grooves are no longer fully worked into the material of the functional surface part but are rather formed by profiled webs 24, which are formed in one piece with the functional surface part and lead to a significant saving of material without functional penalties.

The insert grooves 6 formed by the profile webs 24 are preferably interrupted at a plurality of positions over their longitudinal extent, with the mutually aligned interruptions respectively defining a transverse guide groove 40 for the reception of the coupling lugs 45. In this way stable plugged connections can be established without problem and rapidly. The coupling lugs 45 can be spread apart in the coupled state by the introduction of spreading wedges 47 in the coupled state to achieve the required fixation and can thus be stably clamped to the profiled webs 24. The sectional corner angle part 46 can also be provided with a film hinge to permit angular adjustment.

Figure 1:
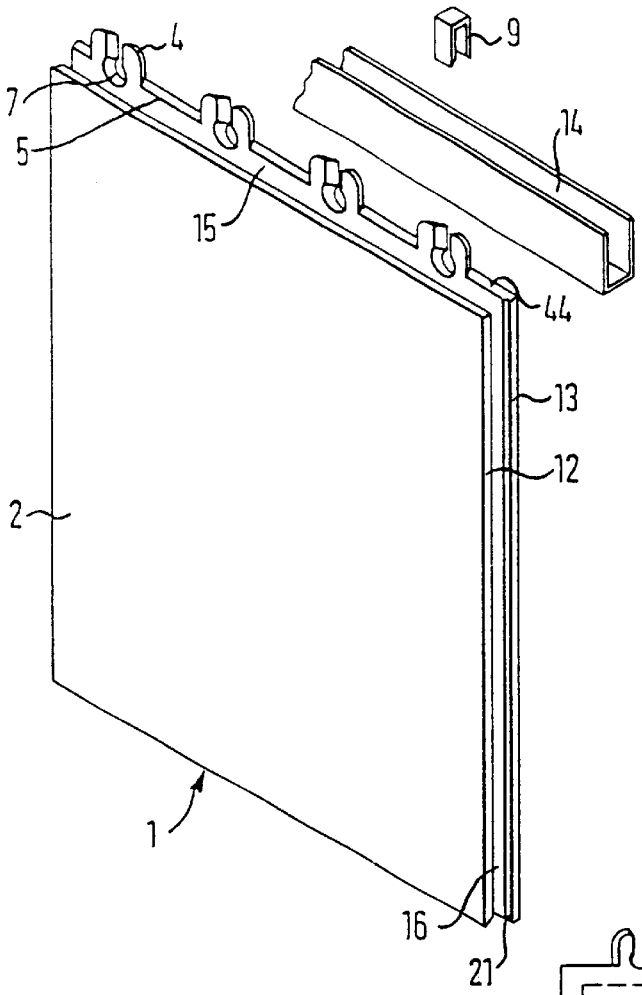
Figure 2:
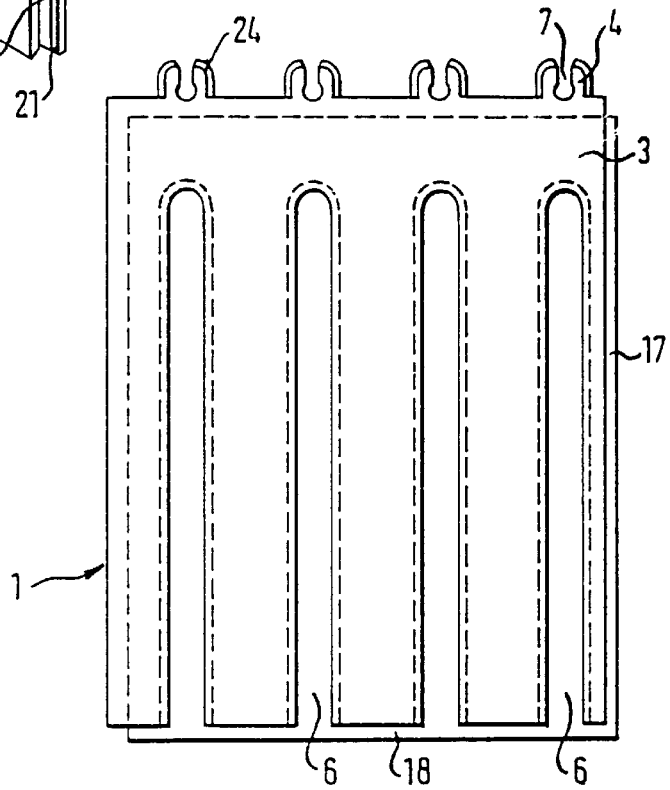

It can also clearly be seen from FIG. 13 that the design of the coupling and fixing members in the form of a double-lug arrangement 38, 39 also leads to an advantageous increase in stability and also to an improvement of the mounting technique. The counter-sunk mounts 10 for attachment screws provided in the individual lugs 38, 39 are distributed in a large number over the width of a module element 1 and a mounting element can in each case be set at a position which is particularly expedient in a particular case. The arrangement of the sliding mount 11 between the two lugs 38, 39 is not only advantageous from the aspect of stability but rather in particular also having regard to facilitating the demolding process in comparison to the embodiment of the coupling and fixing members of FIG. 1.

Figure 14:
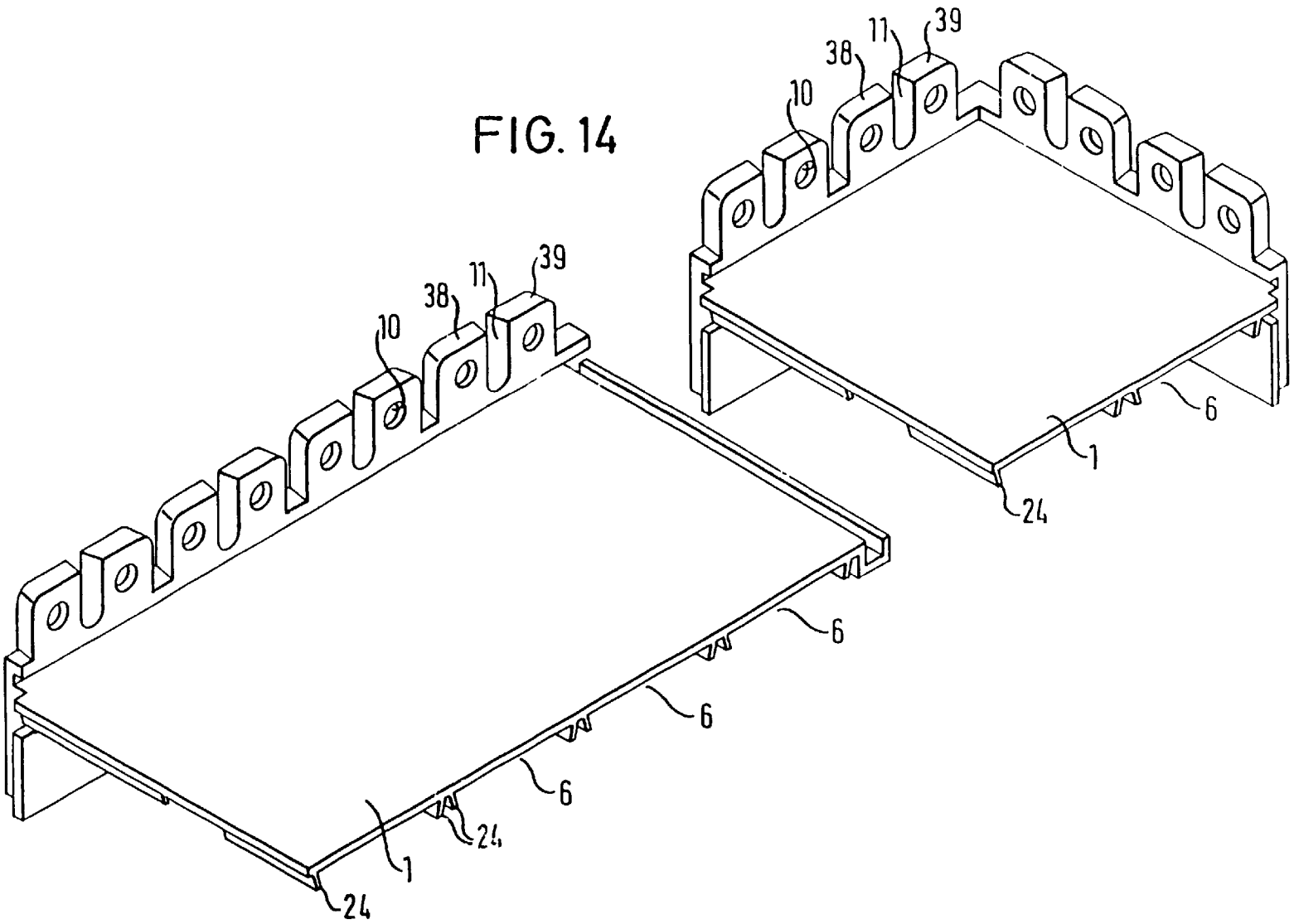

FIG. 14 shows a shelf module and a corner module in order to document the possibilities of variation of the system of the invention which exist.

Figure 15:
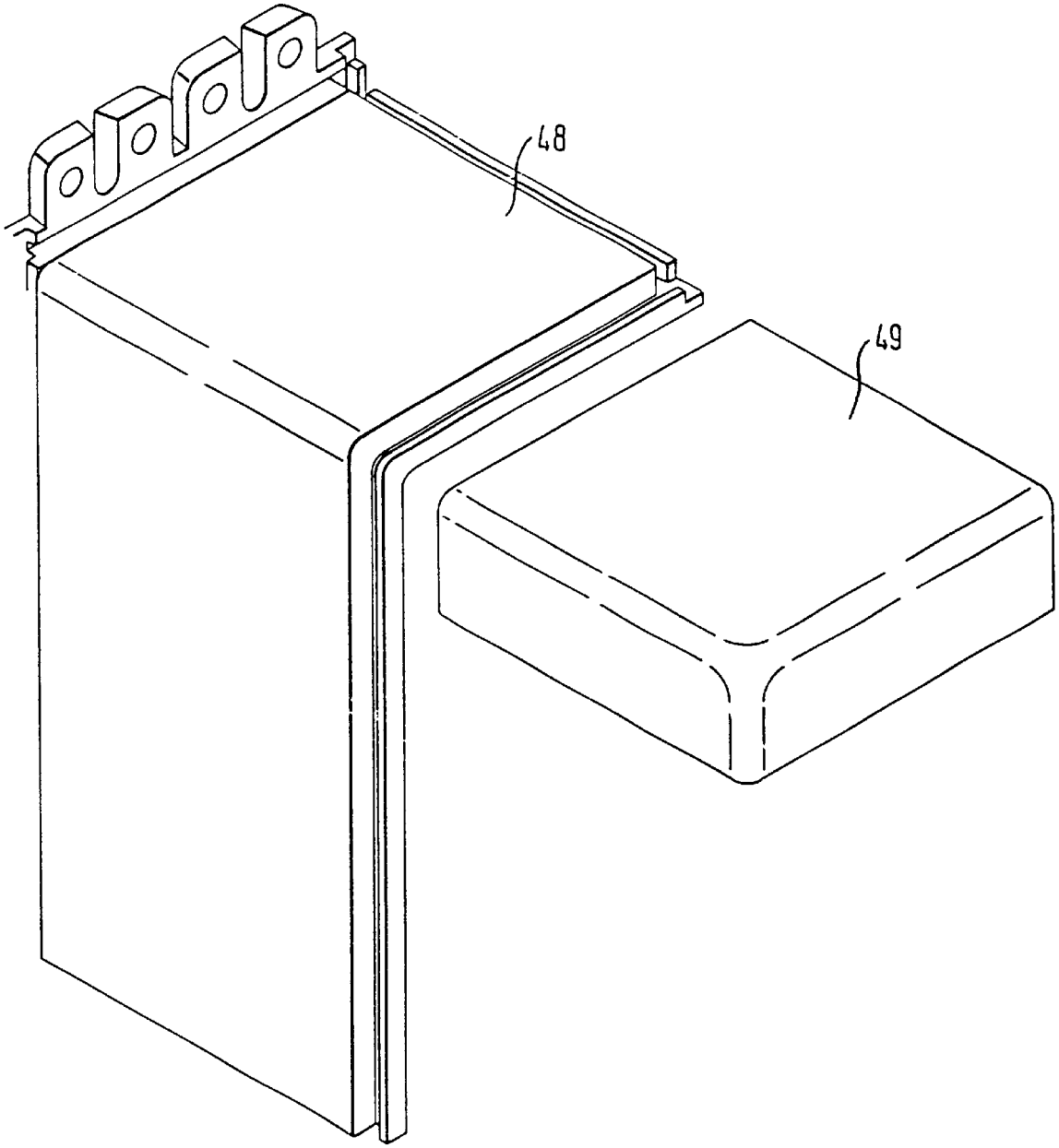

FIG. 15 shows in a perspective illustration angular and cap-shaped tub cladding parts 48, 49, with it being evident that the system of the invention is variable to a large degree with respect to the layout of such special parts, without deviating from the basic concept of the connection and coupling technique.

Figure 16:
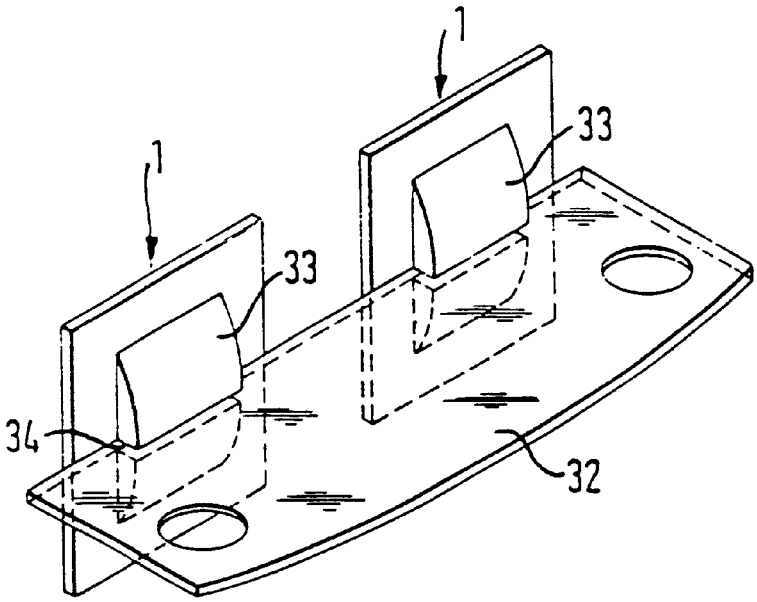

The perspective illustration of FIG. 16 makes it clear that module elements 1 can simultaneously take on holding functions and can, for example, be equipped with carrying regions 33, which determine a fixing gap 14 and can serve to receive and mount a shelf and carrying surface 32 or carrier rod arrangements. In an analogous manner, module elements designed in this way can be so shaped and arranged that a vertically extending mounting gap results for a shower partition wall. In corresponding manner glass holders, soap-dish holders, hand towel holders, roll holders and the like can be fixed in module elements 1 designed in this way.

Figure 17:
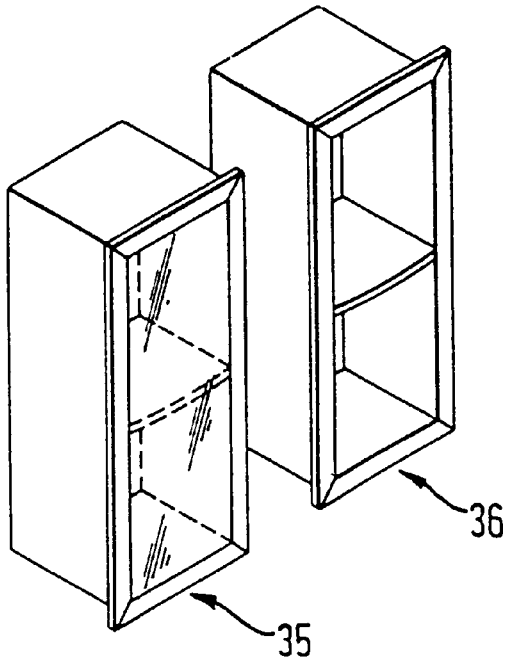

FIG. 17 shows a further interesting design possibility of the invention, which is of significance in connection with the use of installation registers which ensure a spacing between the respective wall and the cladding surface. The module elements can namely also be of three-dimensional design, as is shown in FIG. 17 with respect to a cupboard element 35 and to a shelf compartment 36. Such module elements can either be combined with frame-like functional parts analogous to FIG. 9 or can themselves be provided with such a frame-like functional part so that they can be integrated in accordance with the same mounting technique into the functional walls which are to be constructed. Through a corresponding design of the installation register larger cupboard elements can also be integrated flush into the wall which is to be created.

Figure 18:
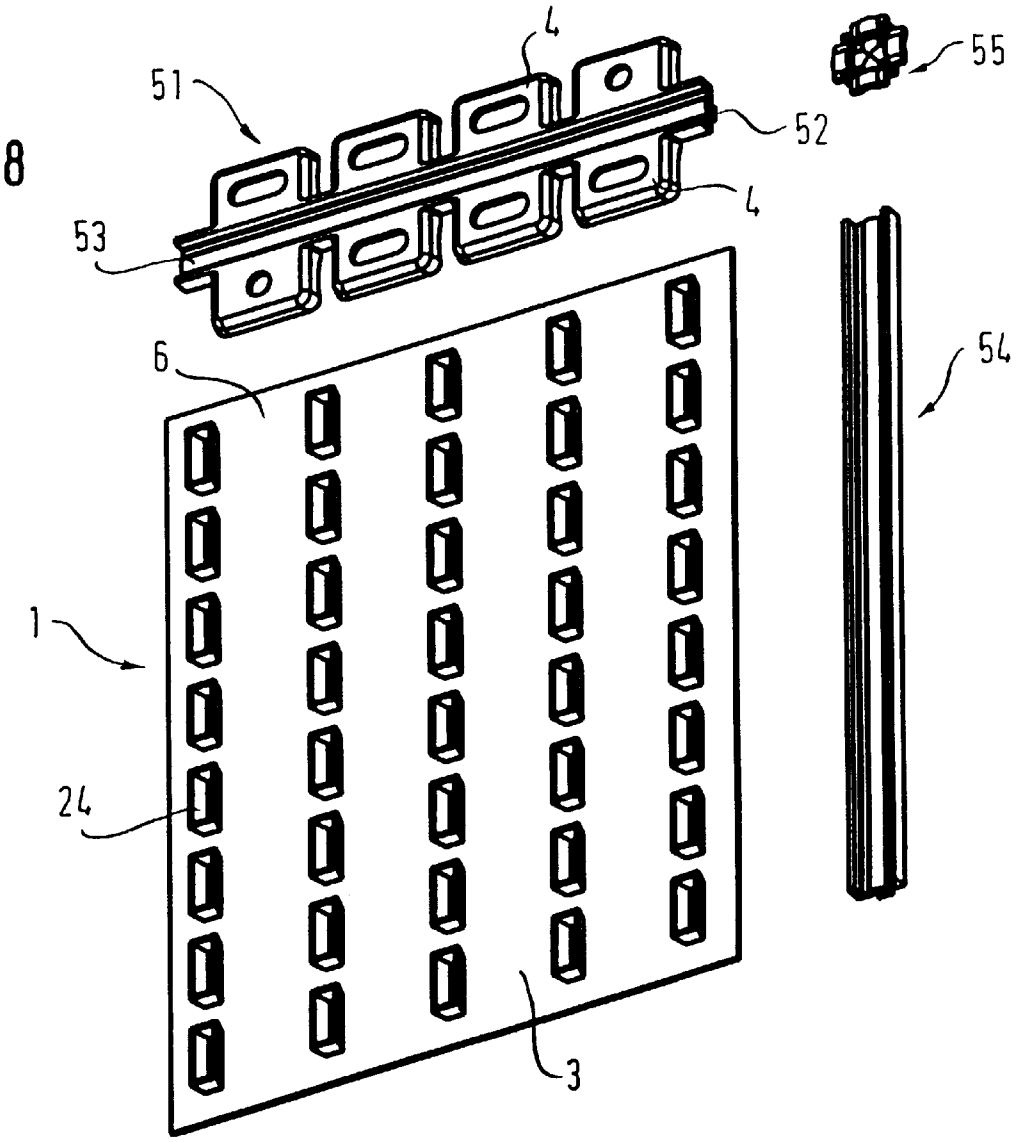

FIG. 18 shows a module element 1 which can, for example, be a tile element and which has a plurality of insert channels extending parallel to one another at the rear side 3. The insert channels are preferably formed by profiled web elements 24 molded onto the rear side, which can be connected to coupling and fixing members 4 in the manner of a dove-tail connection.

The individual profiled web elements 24 are mutually spaced apart so that insert grooves which may also be required in the transverse direction are available, if necessary.

The connection of module elements 1 disposed above one another takes place via adapter elements 51 which are to be used horizontally and which include a centrally extending sealing strip 52 and a plurality of coupling and fixing members 4 arranged on both sides of the sealing strip 52. A connection section 54 to be used vertically is utilized between module elements 1 disposed along side one another and likewise has an integrally molded on sealing strip which will be explained later in detail.

The adapter element 51 which is to be used horizontally and the connection section 54 to be used vertically can be coupled together via a corner connector 55 so that whole surfaces which are sealed against the penetration of water can be provided by the joining together of these components.

Figure 19:
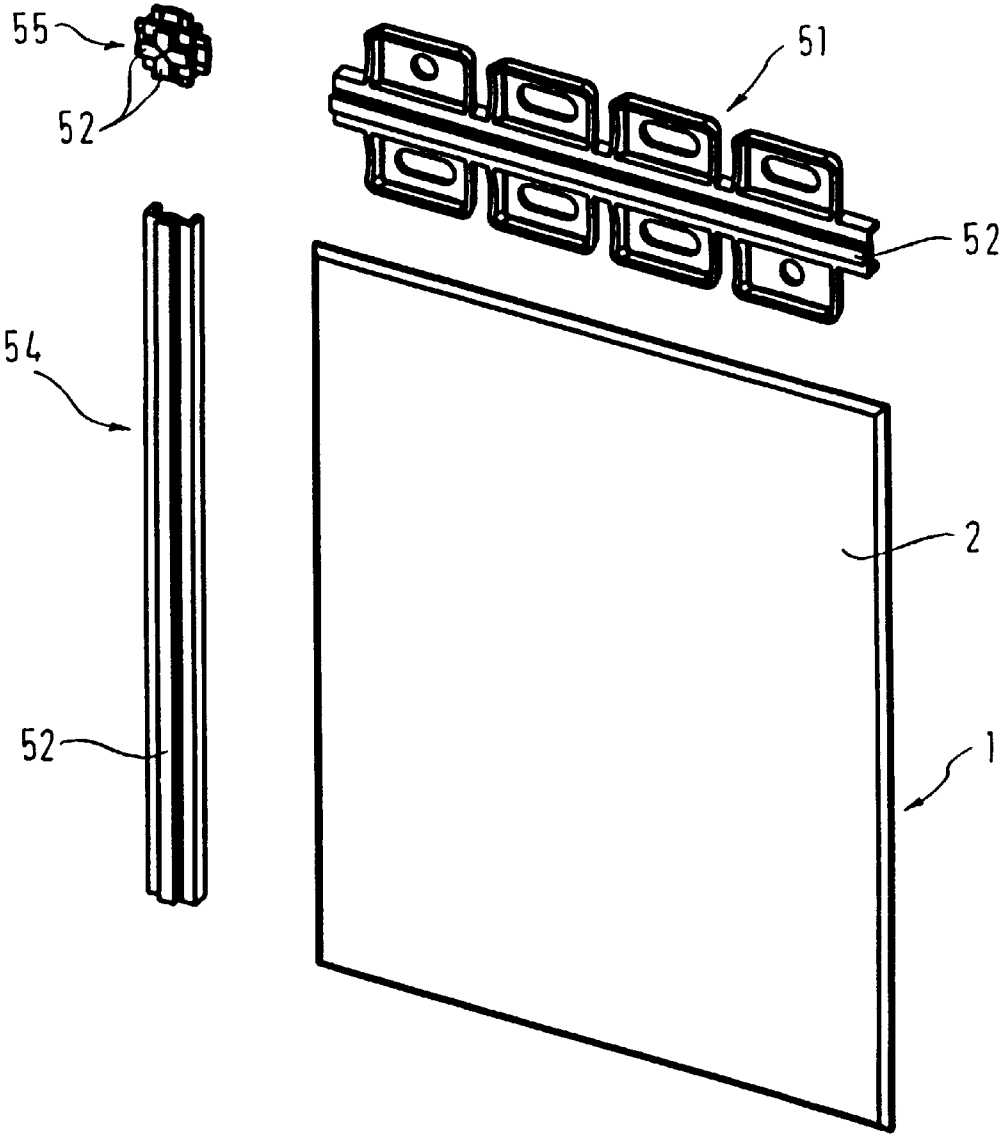

FIG. 19 shows the front view of the arrangement of FIG. 18 and thus the visible side 2 of the module element 1 and also the sealing strips 52 associated with the adapter element 51, the connection section 54 and the corner connector 55.

Figure 20:
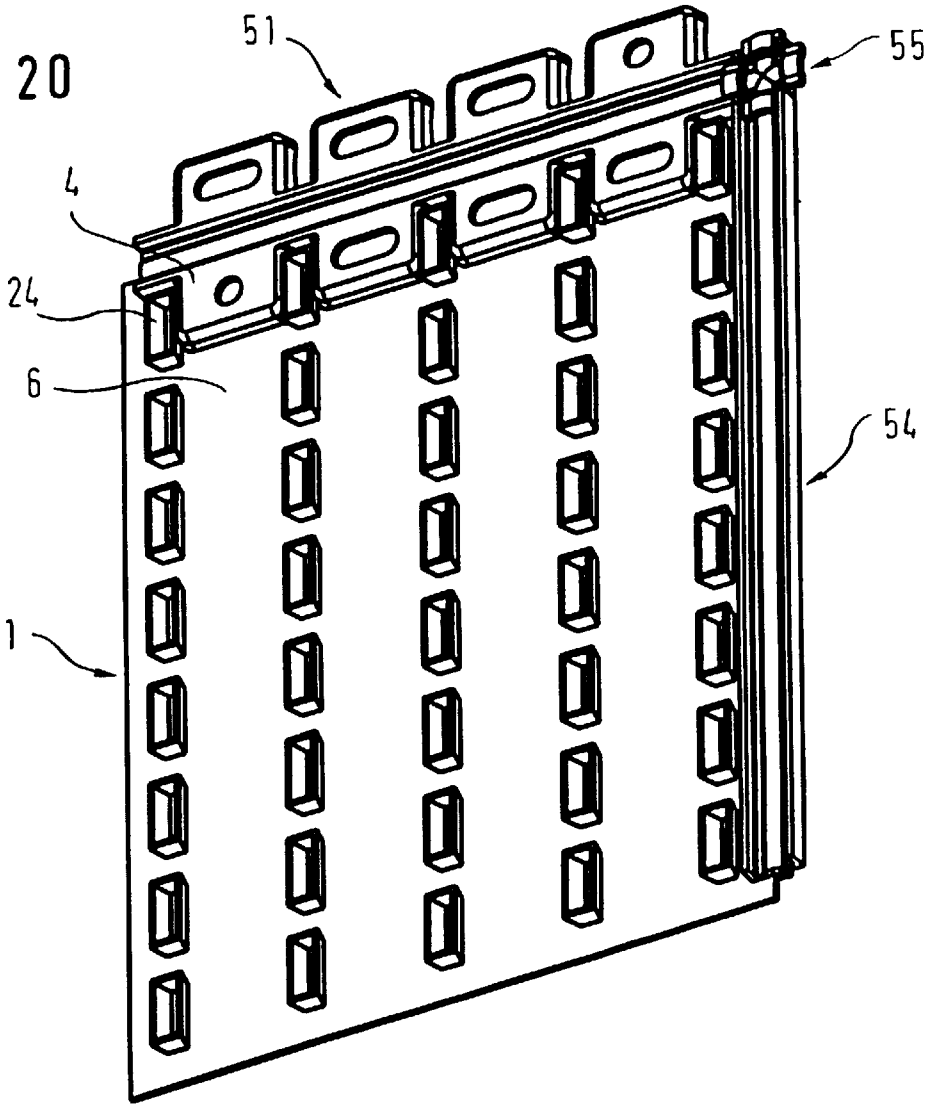

FIG. 20 shows a rear view of the module element 1, with the adapter element 51 being connected in form-locked and force transmitting manner to the module element 1 via the coupling and fixing members 4. This adapter element 1 is also connected via the corner connector 55 to the vertical connection section 54, so that an uninterrupted sealing strip 52 results at the front side.

Figure 21:
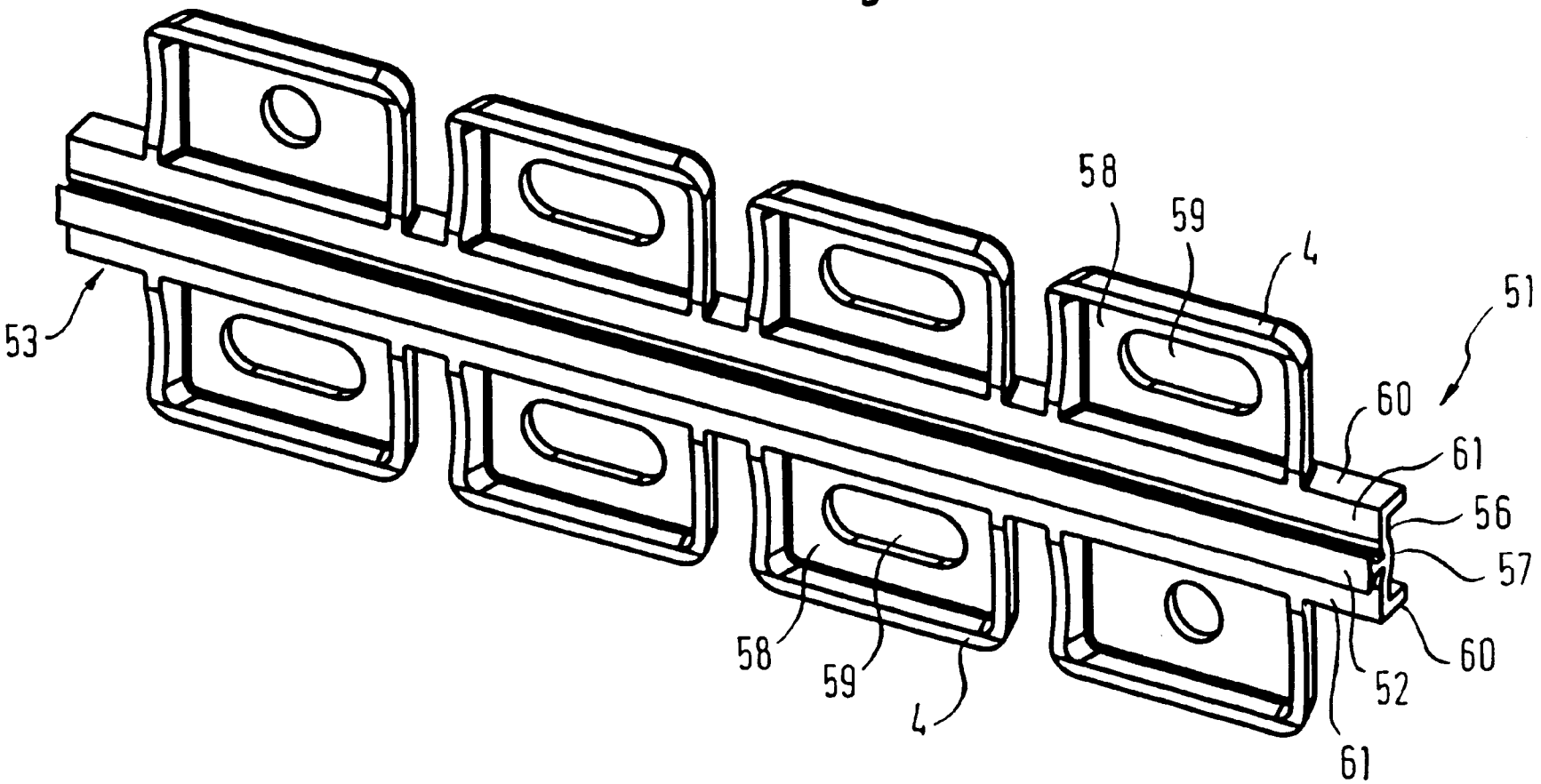

FIG. 21 shows a perspective illustration of the front side of an adapter element 51. This adapter element 51 includes a U-shaped bridge part 53 with the coupling and fixing members 4 being molded onto its side limbs 60 at the outside. These coupling and fixing members 4 are of shell-like design and have a base 58 aligned with the end face of the respective side limbs 60, with the mounting openings 59 being provided in the bases 58.

A sealing strip 52, which extends over the full length of the adapter element, is centrally molded onto the bridge part 53, with the central limb 56 carrying this sealing strip 52, having a compression and/or bending zone 57. Contact surfaces 61 for the respective module elements 1 are located on both sides of the sealing strip 52.

Figure 22:
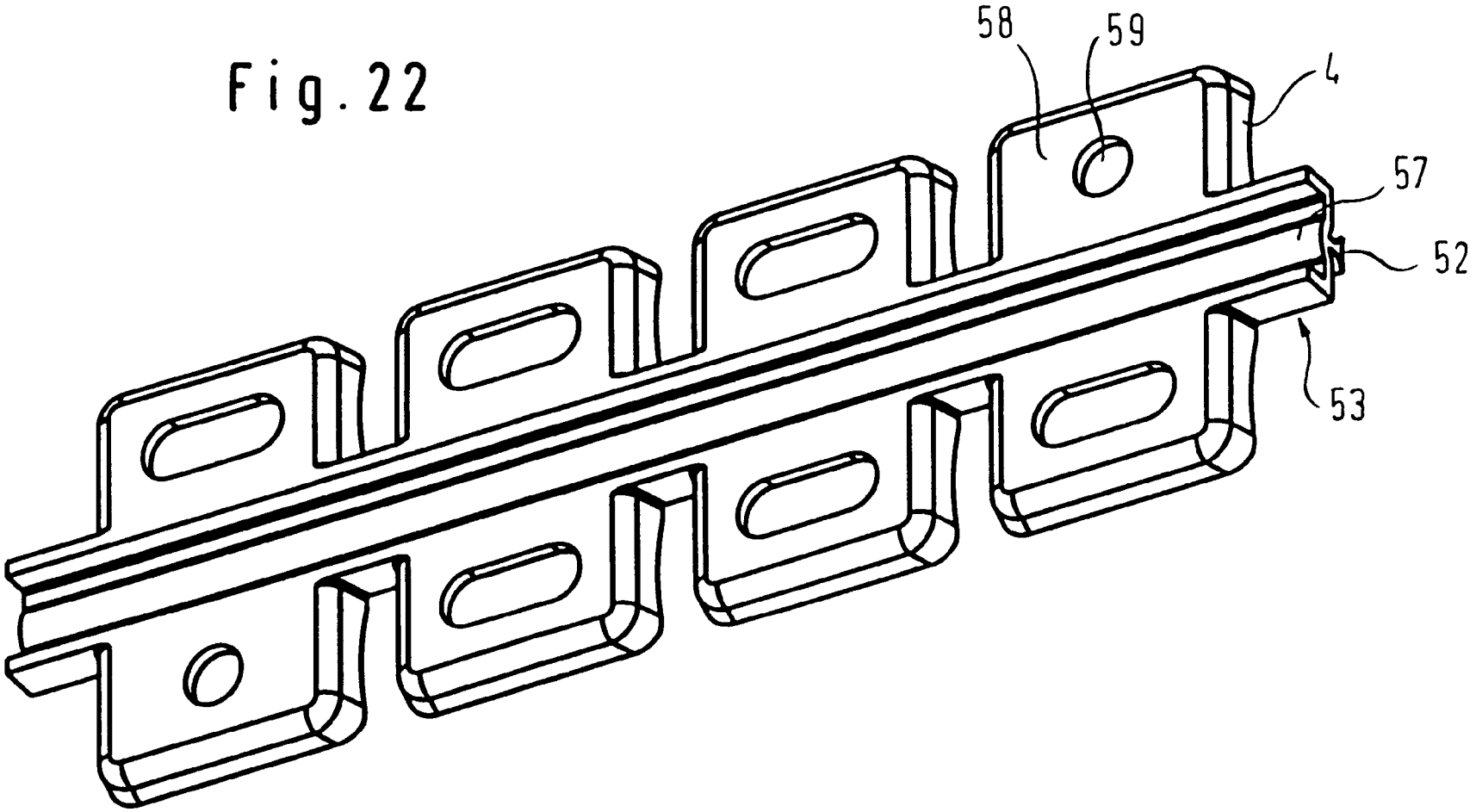

FIG. 22 shows a rear view of the adapter element 51 of FIG. 21, and it can be seen that the bridge part 53 in its central limb has a downwardly curved region which forms the bending zone 57 and which carries the sealing strip 52.

Figure 23:
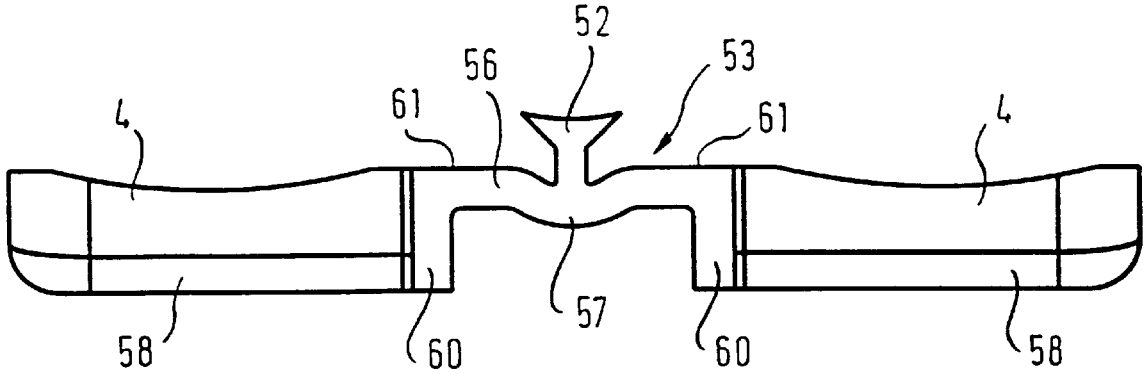

FIG. 23 shows a cross-sectional view of the adapter element 51 in accordance with the FIGS. 21 and 22. The shell-like coupling and fixing members 4 are located on both sides of the bridge part 53, with the bases 58 of the coupling and fixing members 4 extending flush with the ends of the side limbs 60 of the bridge part 53.

The design of the central limb 56 of the bridge part 53 is important since it must enable the bridge part 53 to take up the expansion of the module elements, in particular of the tiles in the joint profile, while nevertheless maintaining the sealed arrangement and the optical design of the joints.

For this purpose the sealing strip 52 which is matched in cross-sectional shape to the joint profile is arranged on a region of the central limb 56 formed as a bending zone 57, with this bending zone 57 consisting of a downwardly curved wall section, and with the deformabilities or elasticities being so selected that expansions which occur are taken up and the sealing strip 52 is always held in a firm and sealed contact in the respective joint. On putting together the module elements through the intermediary adapter elements 51, a pre-stress is achieved through the module elements which lie against the contact surfaces 61 and are pushed against the sealing strip 52. This pre-stress ensures the sealed nature and problem-free optical impression under all the conditions which arise in practice.

Figure 24:
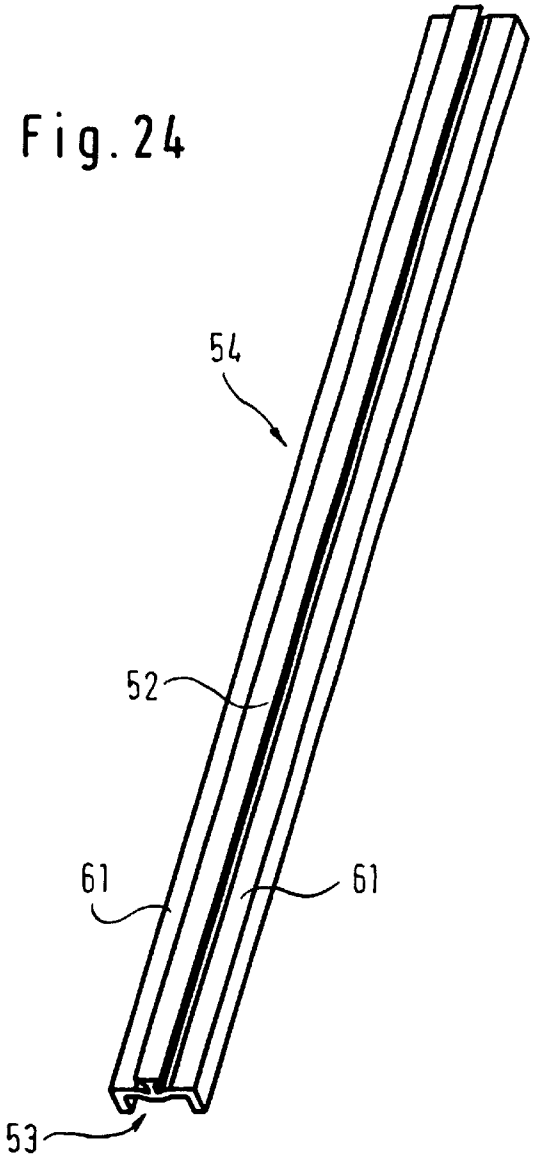

FIG. 24 shows a connection section 54 which is to be used horizontally and which is only substantially distinguished from the already described adapter element 1 in that it has no molded on coupling and fixing members. Accordingly, the connection section 54 likewise consists of a bridge part 53 with an associated sealing strip 52, with contact surfaces 61 for the module elements being provided on both sides of the sealing strip 52.

Figure 25:
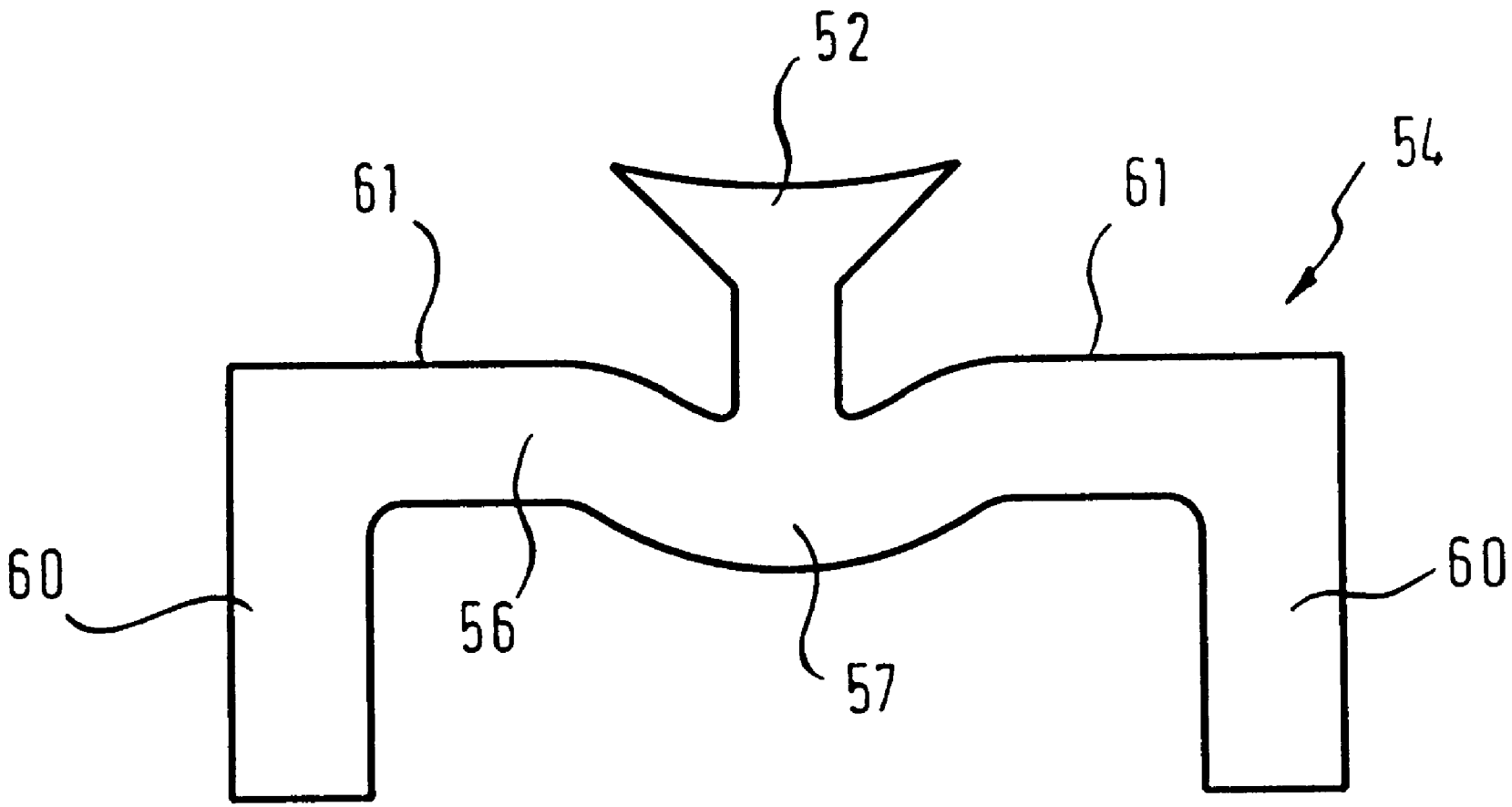

FIG. 25 shows a cross-section through the connection section 54 and permits the U-shaped bridge part to be recognized with the lateral limbs 60 and the central limb 56, which has a continuous bending zone 57 in the region where the sealing strip 52 is molded on analogously to the described adapter element.

Figure 26:
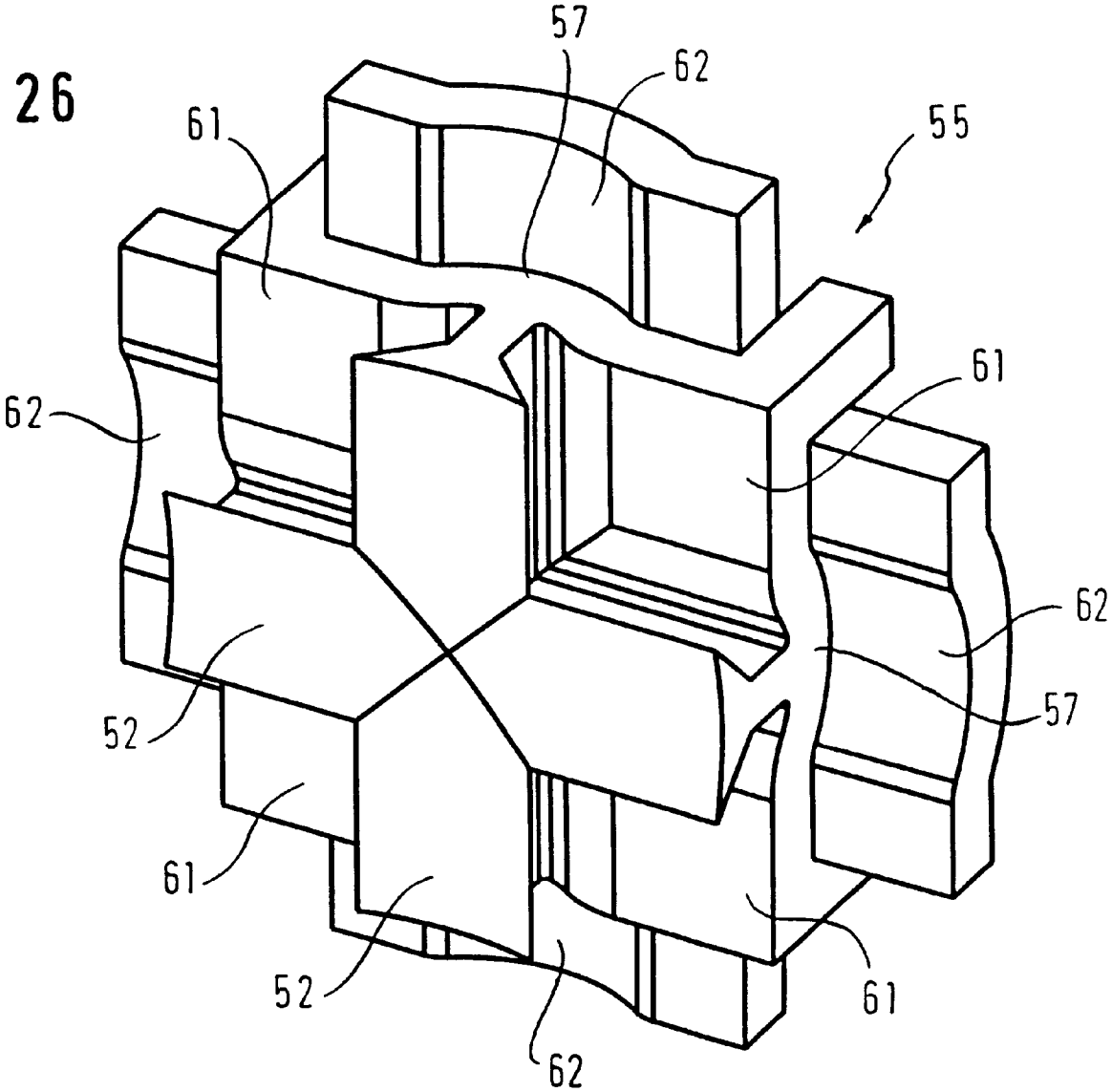

In order to be able to couple adapter elements 51 and connection sections 54 to provide surfaces which are sealed as a whole, a corner connector 55 as shown in FIG. 26 is provided in accordance with the illustration in the FIGS. 18 and 19. The same clamping principle is realized with this corner connector 55 as in the adapter elements 51 and in the connection sections 54 and the penetration of water is prevented by rooftile-like overlap.

The corner connector 55, which is preferably a one-piece shaped part, arises through two portions of the connection section 54 which cross at a right angle in a common plane so that a sealing strip cross 52 arises which is carried by the bending zones 57, as already explained with reference to the adapter element and to the connection section.

Contact surfaces 61 are located on both sides of each sealing strip portion 52 so that in connection with the lateral limbs of the combined bridge parts a table-like overall structure arises. Coupling formations 62 aligned with the four sealing strip portions 52 are provided beneath the central limb of the four-sided bridge part and enable a form-locked coupling with adjoining adapter elements or connection sections.

The corner connector 55 thus makes it possible for the clamping principle realized in connection with the sealing strips to be realized unchanged in the corner region also. Accordingly, continuous and identical behavior of the sealing strips is ensured throughout in the event of expansion of the module elements.

It is also possible in the context of the invention to form adapter elements, connection sections and corner connectors in one piece or in any specific desired combination. It is also important that both the adapter element and also the connection section can always be cut to the requisite length required in a particular case and that the respectively desired joint coloring can be realized by corresponding coloring of the plastic materials which are used.

It is also of importance for all embodiments of the invention that the respective installation can be learned simply and that no particular specialist knowledge is required. Moreover, as a result of the releasable fixation of the module elements, any repairs which are eventually necessary are possible in a simple manner by partial dismantling. In addition, additions and enlargements of the installation can also be effected without problem, for example when functional units such as additional switches, sockets or holders or compartments are to be integrated into a wall construction.

Finally, it should also be mentioned that through the possibility of selection with respect to the material of the visible side of the decorative surface part the same materials can also be used for the sanitary objects, in particular the same plastic materials, so that bathrooms can be designed in a unitary material and thus also in the same color. In order to simplify the machining, auxiliary cutting lines can be applied to the rear side of each module element 1.

What is claimed is:

1. A modular system for cladding of wall, ceiling and floor surfaces and also for the construction of functional surfaces and functional walls, the system comprising a plurality of substantially flat module elements coupled together in a hidden manner with respect to a visible side, the modules being formed as areal, frame-like parts and being freely combinable with one another, wherein at least the substantially flat module elements are coupled together via a plurality of mutually spaced apart coupling and fixing members which project beyond a boundary edge of the module and insert grooves provided at a rear side of the module for a shape-locked and force-transmitting reception of coupling and fixing members of adjacent modules, wherein the coupling and fixing members are formed on adapter elements which are arranged on both sides of a centrally extending sealing strip.

2. A modular system in accordance with claim 1, wherein the sealing strip has a cross-sectional shape which is at least substantially matched to a joint shape and is arranged on a elastically deformable bridge part, with the coupling and fixing members being molded onto the side surfaces of the bridge part.

3. A modular system in accordance with claim 2 wherein the bridge part is made substantially U-shaped, opens toward the module element mounting surface and has a central limb crying the sealing strip, with the central limb deflecting in the direction toward the mounting surface and moving the sealing strip with it on compression by the module elements.

4. A modular system in accordance with claim 3, wherein the central limb is downwardly curved in the region of the molded on sealing strip while forming at least one of a compression and a bending zone.

5. A modular system in accordance with claim 1, wherein the coupling and fixing members molded onto the adapter element have base surfaces preferably being provided with openings for securing elements.

6. A modular system in accordance with claim 1 wherein connection sections are provided for the coupling together of adjacently disposed module elements, wherein the connection sections consist of a resiliently deformable bridge part and a molded sealing strip, wherein the sealing strip has a cross-sectional shape matched at least substantially to a joint shape, and wherein a respective contact surface for marginal regions of the module elements is formed on both sides of the sealing strip on the bridge part.

7. A modular system in accordance with claim 6, wherein the bridge part is substantially of U-shape and opens toward the module element mounting surface and has a central limb which carries the sealing strip and which, on compression by the module elements deflects along with the sealing strip in the direction of the mounting surface.

8. A modular system in accordance with claim 7 wherein the central limb is downwardly curved in the region of the molded on sealing strip while forming at least one of a compression and a bending zone.

9. A modular system in accordance with claim 1, wherein the adapter elements are coupled to vertical connection sections via a corner connector which prevents the penetration of water by a rooftile-like overlap.

10. A modular system in accordance with claim 9 wherein the corner connector includes two portions of a connection section which cross at right angles in a common plane with coupling formations arranged beneath its central limb and aligned with four sealing strip portions, with the coupling formations being insertable in a shape-locked manner into the bridge parts of adjacent adapter elements and connection sections.

* * * * *